US006837087B2

(12) United States Patent
Kleber et al.

(10) Patent No.: US 6,837,087 B2
(45) Date of Patent: Jan. 4, 2005

(54) GUIDE PIN SLOT ARRANGEMENT FOR SUPER PLASTIC FORMING BLANKS PROVIDING IMPROVED BLANK GUIDANCE AND FORMED PART RELEASE

(75) Inventors: Richard Murray Kleber, Clarkston, MI (US); Donald L. Kenyon, Sunfield, MI (US); Verril J. Gamet, Diamondale, MI (US)

(73) Assignee: General Motors Corporation, Detroit, MI (US)

( * ) Notice: Subject to any disclaimer, the term of this patent is extended or adjusted under 35 U.S.C. 154(b) by 293 days.

(21) Appl. No.: 10/242,981

(22) Filed: Sep. 13, 2002

(65) Prior Publication Data

US 2004/0050128 A1 Mar. 18, 2004

(51) Int. Cl.[7] ..... B21D 45/00

(52) U.S. Cl. ..... 72/60; 72/344; 72/420; 428/571; 428/577

(58) Field of Search ..... 72/60, 344, 420, 72/427; 428/571, 575, 577, 582, 596

(56) References Cited

U.S. PATENT DOCUMENTS

| | | | | |
|---|---|---|---|---|
| 2,975,818 A | * | 3/1961 | Rippe | 72/331 |
| 3,854,359 A | | 12/1974 | Tagami | 83/212 |
| 5,259,230 A | | 11/1993 | Beyers | 72/294 |
| 5,604,044 A | * | 2/1997 | McCabe et al. | 428/577 |
| 5,819,572 A | | 10/1998 | Krajewski | |
| 5,974,847 A | | 11/1999 | Saunders et al. | |
| 6,085,571 A | | 7/2000 | Brinas et al. | |
| 2002/0152783 A1 | | 10/2002 | Kleber et al. | 72/60 |

* cited by examiner

*Primary Examiner*—Lowell A. Larson
(74) *Attorney, Agent, or Firm*—Kathryn A. Marra

(57) ABSTRACT

A blank positioning and guide construction which includes guide pin slotting that effects the accurate positioning of the sheet on the forming die and guide pin thereof and which provides for the enlargement of the guide pin slot by the predetermined deformation of portion of the sheet at a predetermined bend line adjacent to the guide pin slot to eliminate adherence of the part to the pin so that the part can be ejected from the die without detrimental part distortion of the part.

6 Claims, 3 Drawing Sheets

GUIDE PIN SLOT ARRANGEMENT FOR SUPER PLASTIC FORMING BLANKS PROVIDING IMPROVED BLANK GUIDANCE AND FORMED PART RELEASE

TECHNICAL FIELD

This invention relates to the art of manufacturing parts using sheet metal blanks and forming dies and more particularly to new and improved constructions and techniques for the superplastic forming of metal parts with rapid and trouble free extraction of formed parts from forming dies.

BACKGROUND OF THE INVENTION

Prior to the present invention, various types of forming equipment and processes have been developed for quantity production improvements to shape blanks of metallic materials into a wide range of items. Among such equipment and processes are super and quick plastic forming dies and processes in which a ductile sheet of superplastic metal alloy is heated and stretched onto the forming surfaces of heated dies to produce high-quality, light-weight parts such as panels for automotive vehicles. Often such sheets are quite large so that trunk lids, engine hoods or other large panels can be formed in one piece. Examples of such processes and equipment are found in U.S. Pat. No. 5,974,847 issued Nov. 2, 1999 to Sanders et al for Superplastic Forming Process and U.S. Pat. No. 5,819, 572 issued Oct. 13, 1998 to P. E Krajewski for Lubricating System For Hot Forming, both assigned to the assignee of this invention and both hereby incorporated by reference.

In the patent to Sanders et al. a blank sheet of metal alloy is heated to a superplastic forming temperature and is pulled over and around a forming insert in a die set. Subsequently using differential gas pressure, the sheet is further stretched into conformity with a forming surface of the insert so that thinning of the formed part is minimized. In the patent to Krajewski, dry lubricant is applied to a metallic sheet which is subsequently heated to predetermined forming temperatures and formed into a part in superplastic forming die equipment. The lubricant initially provides improved forming of the part and subsequently improved release of the formed part from the forming die.

Formed part removal is further addressed in copending patent application Ser. No. 09/837,597 filed Apr. 19, 2001 by R. Kleeber et al for Panel Extraction Assist for Super and Quick Plastic Forming Equipment assigned to the assignee of this invention and hereby incorporated by reference. In the above-identified application, forming pressures used for making superplastic parts in hot forming dies are further employed for improved ejection of the part from the forming die.

While the above identified patents and patent application constructions provide improvements in super and quick plastic forming they often do not attain new and higher standards for the production of such formed parts with minimized part rejection from part distortion resulting from part ejection forces. More particularly with some equipment, difficulties have been experienced in quantity production in accurately positioning the blanks or sheets onto the forming die and then subsequently removing the formed part or panel without distortion or other damage from release or ejection forces.

The employment of guide pins and cooperating guide pin slots for the forming die and blank sheet respectively to precisely position the blank sheet on the forming die has only met with limited success in view of the fact that the material of the blank expands or otherwise distorts during the forming process and grips onto the guide and positioning pin. This gripping inhibits removal of the formed panel from the die. Often the formed panel is distorted to such an extent by the part ejection forces moving the part from the pin and the associated forming die that the panel has to scrapped and recycled. FIG. 4 of the accompanying drawings illustrates prior art panel distortions from the panel being held to the forming die by the guide pin and in response to ejection forces being applied to remove the panel.

SUMMARY OF THE INVENTION

In contrast the prior art, the present invention is drawn to new and improved methods and constructions that provides improved blank positioning on the forming die and improved formed parts. This invention importantly meets higher standards for ejection and removal of high quality formed parts from hot super plastic and quick plastic forming dies particularly while in the press and operating at elevated temperatures. More particularly, the invention is directed to the quick and effective removal of super plastically formed parts from hot forming dies without part damage.

The present invention specifically alleviates blank guidance and formed part removal problems by providing a new and improved guide pin slot configurations that have adequate in-plane stiffness for blank locating purposes. The configurations further provides discrete offal or waste areas in the part responsive to removal forces particularly those angled to the plane of the part to allow limited and controlled bending of such predetermined and specific waste areas of the part to enhance part removal from the forming die.

This invention provides a new and improved positioning and guide slot arrangement in a blank of formable sheet material such as aluminum alloy which is engineered to cooperate with an upstanding blank locating and positioning guide pin of a forming die that augments removal of a formed part from the die. When the formed part is being ejected a guide pin slot in a sacrificial or waste part of the formed member is frictionally engaged by the surface of the pin that effects the bending of the waste part that turns away from the guide pin and effects enlargement of the pin guide slot to enhance release of the formed part from the forming die and the guide pin thereof.

It is a feature, object and advantage of this invention to provide a new and improved guide pin slot arrangement in a blank of sheet metal to be formed into a part of predetermined shape that allows the controlled deformation of specific waste areas of the part containing the slot arrangement on removal from the guide pin of the forming die. In this invention side walls in the waste area defining the guide pin slot can physically contact the guide pin as the formed part is being removed from the die to cause the waste portion to bend along a predetermined bend line so that the guide pin is clear of the part to thereby augment part removal without part distortion or other damage.

Another feature object and advantage of this invention is to provide new and improved blank positioning and guide pin slot arrangement in a blank of sheet material used in superplastic forming that augments removal of a part formed from the blank on a forming die having a guide pin that cooperates with the guide pin slot to accurately position the blank on the forming die.

Another feature object and advantage of the present invention is to provide a new and improved guide pin slot arrangement in a blank to be superplastically formed that prevents the gripping of the formed part onto a guide pin carried by the forming equipment to allow the formed part to be easily removed from the equipment by part extraction forces.

In a preferred form of the invention a centralized guide pin receiving slot is bounded on either side by edge slots that extend from predetermined positions in the periphery of the blank to predetermined terminal points to thereby establish specific bend lines or hinges in the blank that easily bend under load when the part is removed from a forming die to enlarge the pin slot to augment removal of the part from the guide pin and the associated die.

BRIEF DESCRIPTION OF THE DRAWINGS

These and other objects, advantages and features of the invention will become more apparent from the following detailed description of one preferred embodiment of the invention and drawing in which.

DESCRIPTION OF THE PREFERRED EMBODIMENT

Figure 1:
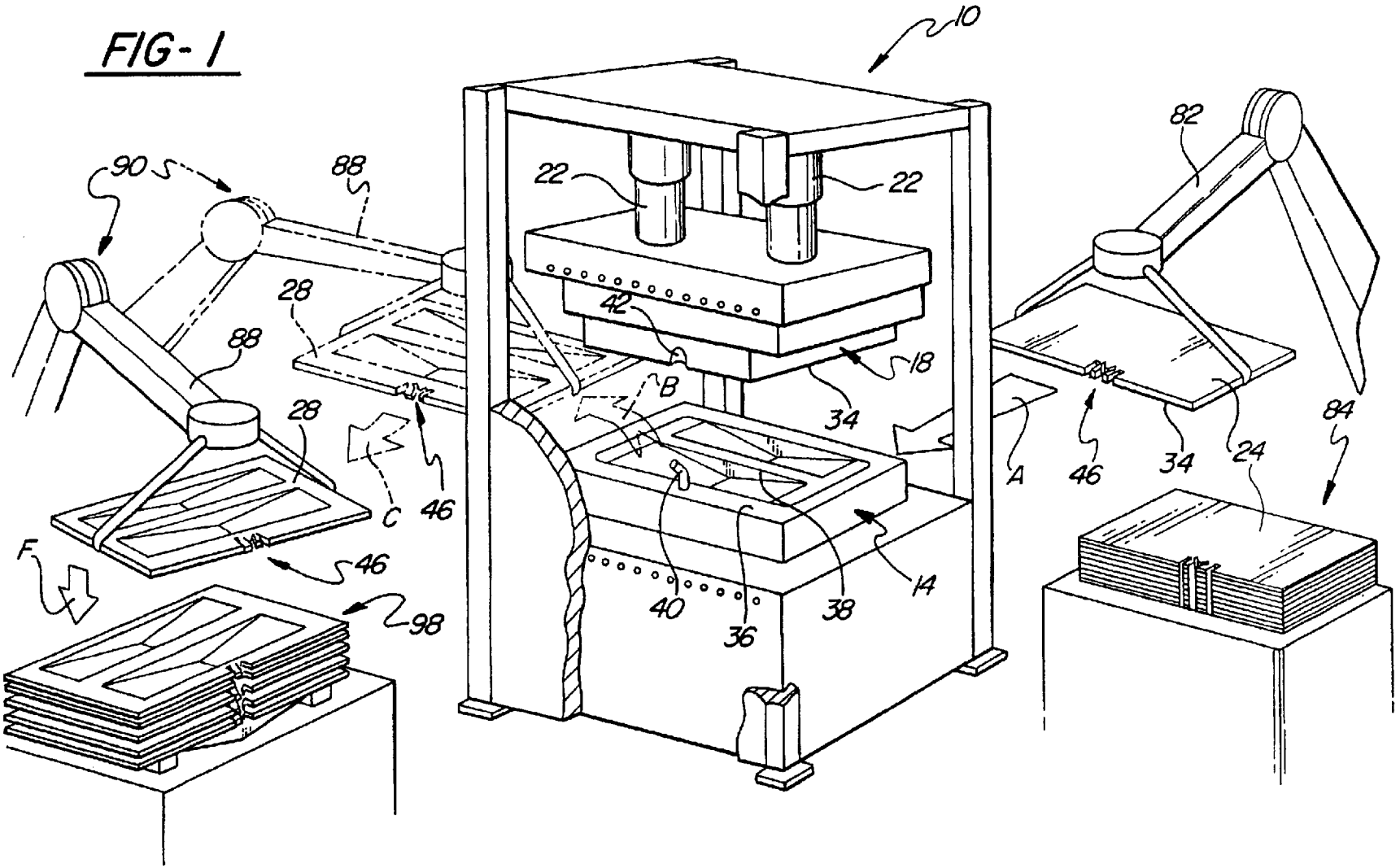
FIG. 1 is a pictorial view of a superplastic forming equipment forming sheet metal blanks into formed parts.

Turning now in greater detail to the drawing, FIG. 1 illustrates a forming press 10 comprising a lower bolster plate 12 on which lower steel or forming die 14 is mounted. The press additionally has an upper reciprocating ram plate 16 that carries a chambered upper tool 18 that corresponds to the upper tool of the above referenced U.S. Pat. No. 5,819,572. Both plates 12 and 16 may be electrically heated to establish the required heat energy levels in the die and the sheet metal blanks 20 loaded therein for super and quick plastic forming as is known in this art. Forming die 14 can be mounted on the upper plate instead of the lower plate and the chambered upper tool 18 operatively supported on the lower plate if desired and depending on the characteristics of the part to be made.

The ram plate 16 is cycled by hydraulic cylinders 22 from the illustrated open position shown in FIG. 1 for blank loading to the closed position for blank forming and then back to the open position for removal of the formed part from the hot forming die. A second blank can then be loaded onto the forming die for another part forming cycle. The blanks utilized with one preferred embodiment of this invention are flattened rectilinear sheets 24 of aluminum alloy coated with a dry lubricant such boron nitride to function as an agent to enhance the stretching and forming of the part during super plastic forming operation and as a release agent to prevent the formed panel 28 from sticking to the die thereby enhancing part release.

As best shown in FIG. 1 the upper tool 18 is operatively connected to the ram plate and projects downwardly therefrom. This tool has a downwardly extending and rectilinear peripheral wall whose free end provides a continuous face seal that sealingly engages the upper surface of the metal sheet 24 along a continuous sealing line 32 that extends adjacent to the peripheral edge 34 of the sheet. This contact establishes an air chamber when the upper tool is brought into engagement therewith during part forming operation. The air chamber is supplied with a suitable inert gas such as pressurized air from a compressor or other source via airlines that connect to an orifice in one of the walls thereof leading to the chamber. Moreover, the forming equipment may be provided with conventional air control valves therein to control the feed and exhaust of air with respect to the air chamber for metal forming operations as disclosed in the referenced patent application Ser. No. 09/837597.

Figure 2:
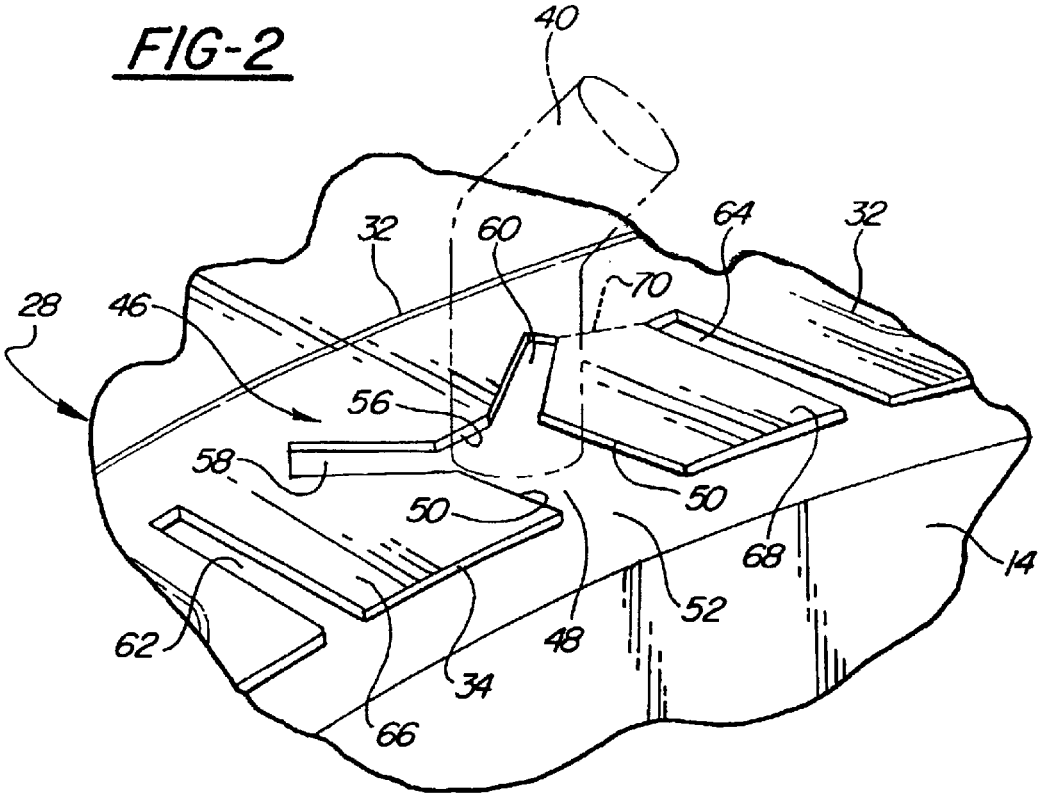
FIG. 2 is a pictorial view of a portion of the forming equipment of FIG. 1 illustrating the guidance and locating of the sheet blank onto the forming die.

The lower tool or forming die 14 extends upwardly from support by the face of the bolster plate 12 and has a rectilinear peripheral wall terminating in a flattened end face 36 for support of the alloy sheet 24 when loaded thereon. The lower tool further comprises a thick main forming body profiled to form the desired configuration of the part being produced. As best shown in FIGS. 1 and 2 the lower forming die 14 has an upwardly extending blank guide pin 40 comprising a cylindrical steel member anchored at a predetermined station in the blank supporting end face thereof. The pin has an outwardly bent end portion so that it can readily be received by the inclined or slanted clearance recess 42 in an the wall of the upper tool 18 to allow sealing closure of the upper tool onto the blank loaded on the forming die for part forming operation. Various part ejection devices can be employed with this invention such as ejection pins, air assisted ejection as disclosed in the above referenced co-pending patent application Ser. No. 09/837,597 or removed by an operating arm of an associated robot.

The guide pin 40 is further designed to be operatively received in a guide and positioning slot arrangement 46 formed in the sheet 24 in an area which is to be subsequently removed or concealed in the final use of the formed part. More particularly the guide and positioning slot arrangement has a main channel 48 which is generally rectilinear and is in part defined by opposing straight sides 50 spaced at a width which is slightly greater than the diameter of the cylindrical guide pin 40. The main channel of the guide pin slot arrangement extends through the peripheral edge 34 of the blank and defines an open gate 52 for receiving the guide pin so that the sides can contact and guide the sheet onto the forming die. The main channel further extends to a terminal inboard edge or end 56 that may be horizontal or curved to fit the periphery of the pin to make an effective stop for the upstanding pin 46 so that the blank being guided by the slot is positioned at a predetermined location on the forming die with precision to augment the forming of an acceptable formed part.

The inboard end of the slot communicates with left and right side branches 58 and 60 that extend at predetermined angles from direct communication with the end of the guide pin channel. The overall shape of the main channel and the mirror-imaged side branches may define an Y shaped configuration although other configurations, such as a T-shape could be used. These branches cooperate with left and right side boundary slots 62, 64 generally parallel to and offset to either side of the main channel 48. The boundary slots, the pin channel, and its branches cooperate to define left and right side offal or waste parts 66,68 of the blank. More particularly these portions are further defined by left and right side live hinges or bend lines 70,72. The hinges 70,72 are generally linear, intentionally weakened bend lines which extend from respective ends of the side branches to the associated ends or terminal points of the left and right side boundary slots 62 and 64 to allow controlled bending of the waste parts or offal 66,68 away from the guide pin and thereby augment removal of the formed panel or part from the forming die without bending of the formed areas of the parts or other damage.

Figure 1A:
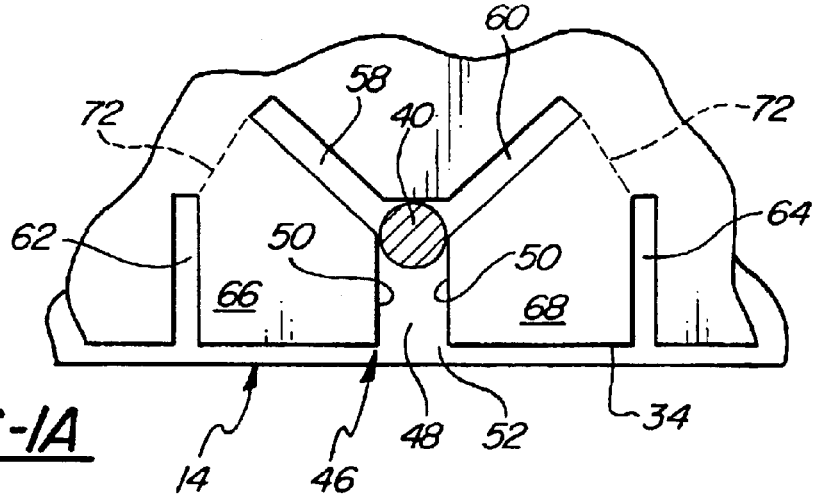
FIG. 1*a* is a plan view of a portion to the sheet metal blank of FIG. 1 as positioned on a blank guide and positioning pin of a forming die

In operation of a preferred embodiment, a robot 80 or other suitable loading unit turns and lowers an operating arm 82 thereof to pick up a top sheet or blank 24 from a stacked supply 84 of blanks. The arm 82 of the robot moves forwardly from the elevated position illustrated in FIG. 1 in the direction of the arrow "A" and into the press to load the blank on top of the hot forming die 14. As the blank 24 is being displaced as shown in FIGS. 1, 1*a* and 2 the guide pin 40 of the forming die clears the open gate 52 and enters the main pin channel 48 which cooperates therewith and effectively guides the moving blank into predetermined position on the forming die. The final position of the blank on the forming die is established by contact of pin 40 with the end 56 of the guide pin channel. With the blank loaded and released, the robot moves to an out of way position.

The ram plate then moves downwardly so that the upper tool establishes operative sealing engagement with the heated blank seated on the die. Appropriate forming pressure is then fed into the forming chamber of the upper tool for part forming. The part is superplastically formed as is known in this art and the upper tool is subsequently raised to expose the formed part on the die. The arm 88 of a second robot 90 or other suitable unloading tool is moved into the opened forming equipment to pick up the hot formed part 28 that has a facsimile of the profile of the forming tool 14.

Figure 1B:
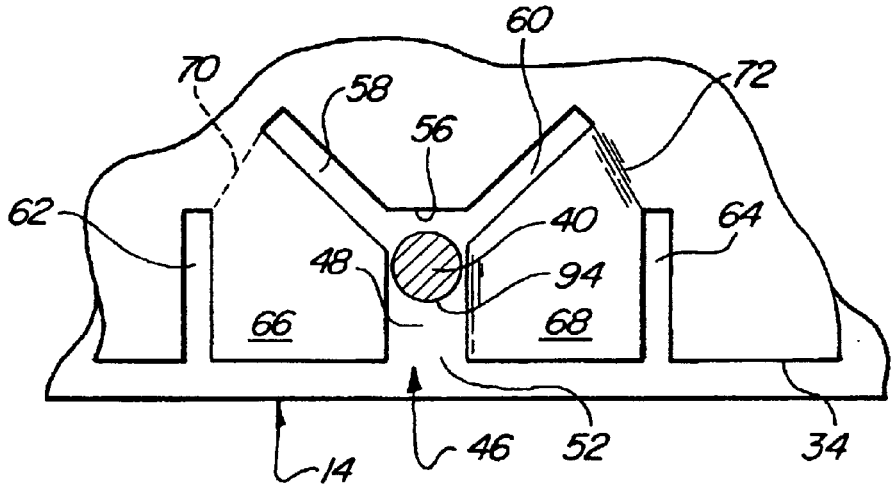
FIG. 1*b* is a plan view similar to the view of FIG. 1*a* illustrating the removal of the blank from the pin.
Figure 3:
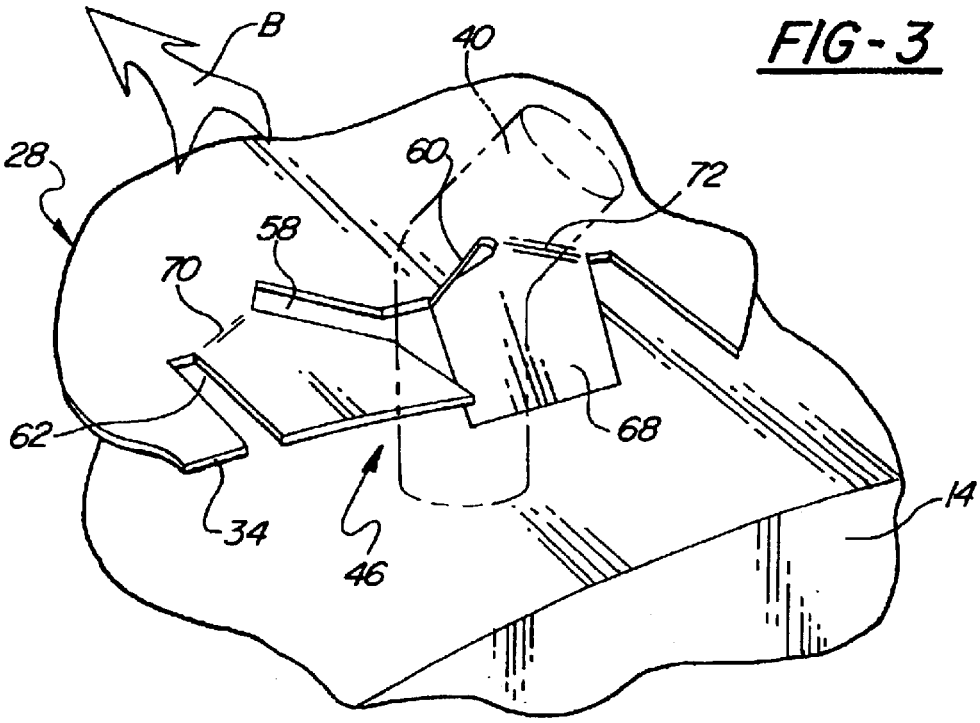
FIG. 3 is a pictorial view similar to FIG. 2 illustrating the formed part being removed from the forming die.

As the part is picked up by the robot arm 88 or otherwise ejected from the forming either die either or both sacrificial parts or offal 66,68 of the formed part may be bent downwardly. This may occur because of frictional contact of the pin 40 with either or both sides 50,50 of the guide pin channel as the formed part is moved off of the forming die. Part flow arrow B diagrammatically illustrates the unencumbered removal of a finished part from the forming die. For example, the waste part or offal 68 shown in FIG. 1*b* and FIG. 3 is bent downwardly, turning a limited amount along live hinge line 72.

The waste part 68 is accordingly displaced by direct contact with the guide and positioning pin as the formed part 28 is moved off of the forming die by part ejection forces. This turning movement of the waste part significantly enlarges the guide pin —main slot clearance such as diagrammatically illustrated at 94 in FIG. 1*b* and ensures that the part being removed from the forming die does not hang up on the pin and be deformed by part removal forces. The parts so removed are acceptable and are accumulated in a stack 98 by the robot arm 88 moving the part as illustrated by part flow arrows C and D.

Figure 4:
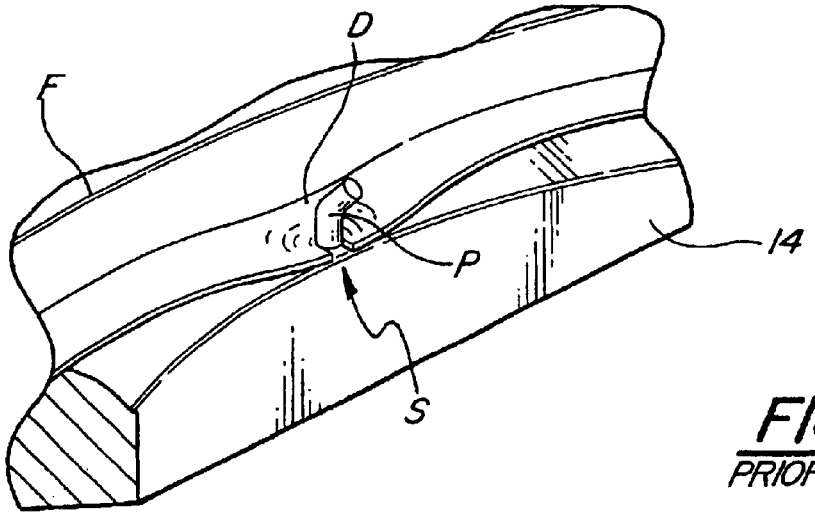
FIG-4 PRIOR ART
FIG. 4 is a pictorial view of a prior art construction showing a part being removed from a guide pin of the forming die.

In contrast, FIG. 4 shows a prior art slot configuration S and illustrates part deformation D resulting when a formed part F being removed from the forming die is hung up on guide pin P of a forming die fitted into the slot S provided in the blank.

In any event, such deformation is substantially obviated with the new guide pin slot arrangement of this invention so that large numbers of identically formed parts can be successfully made with no adverse part deformation or bending and with minimized part rejection.

While the bend lines 72 are shown as being angled from the horizontal in FIGS. 1*a* and 1*b* for example so that the waste areas bend away from the pin on part ejection, the bend lines could be horizontal or have other orientations to enhance formed part removal. As indicated above, both sacrificial areas can bend during part removal as the part may have some lateral movement as it is being moved off the pin. In all of these designs, the slotted areas of the blank that is subsequently removed or otherwise altered such as for fitting with an adjacent part or to accommodate tubing or wiring.

While some preferred methods and mechanisms have been disclosed to illustrate this invention, other methods and mechanisms embracing this invention will now be apparent to those skilled in the art. Accordingly, the scope of the invention is to be considered limited only by the following claims.

What is claimed is:

1. A metallic sheet comprising a flattened body bounded by an edge and conditioned to be positioned on and subsequently shaped by a forming die into a part of predetermined shape, said die having a sheet guide and positioning pin extending outwardly therefrom, said sheet having a sheet positioning slot arrangement formed therein operative for reception of the sheet guide and positioning pin, said slot arrangement comprising a primary channel having opposing side walls spaced from one another defining a width sufficient to receive and guide on said pin, said primary channel extending through said edge and terminating at an end wall intersecting said side walls, at least one branch slot extending at an angle from the end of said primary channel to a terminal end, a boundary slot in said sheet spaced at a predetermined distance to one side of said primary channel, said boundary slot extending through said edge to a predetermined terminus adjacent to said terminal end of said branch slot and cooperating therewith to define a hinge in said body of said sheet, said primary channel and said branch cooperating with said boundary slot and said hinge to define an expendable waste portion of said formed part, said expendable waste portion being adapted to be turned with respect to said hinge by forces ejecting said formed part from said forming die to effectively enlarge said primary channel to prevent the formed part from being retained by said pin so that said part can be removed from said pin and said forming die without further deformation of said part.

2. A metallic sheet comprising a flattened body bounded by edge portions and conditioned to be positioned on and subsequently shaped by a forming die into a part of predetermined shape, said die having a sheet guide and positioning pin extending outwardly therefrom, said sheet having a sheet positioning and guide slot arrangement formed therein for cooperation with the sheet guide and positioning pin to position the sheet on said forming die, said positioning and guide slot arrangement comprising a primary guiding slot having opposing edges defining a width to slidingly fit said pin and guide said sheet into an operable position on said die, said primary slot leading through an edge portion of said sheet to a predetermined terminal end in said sheet, at least one branch slot extending away from the terminal end of said primary guiding slot to an end station and a boundary slot extending from said edge portion to a point near the end station of said branch slot and cooperating with said primary slot and said branch slot to define a waste part and further cooperating with said branch slot to define a live hinge for said waste part to allow said waste part to bend therealong after said sheet has been formed by said die to allow said formed part to be removed from said die without further bending of said part shaped by said forming die.

3. The construction of claim 2 and wherein said sheet positioning and guide slot arrangement has a pair of branch slots extending away from the terminal end of said primary slot that cooperates therewith to form a Y shaped configuration and wherein there are a pair of boundary slots bracketing said primary guiding slot and respectively extending from said edge portions to points near the end of said branch slots to define left and right side waste parts, each of said waste parts being connected to the remainder of said sheet by live hinge portions that allow either of said waste parts to bend away from the pin on said forming die when removed therefrom to enhance removal of said formed part from said forming die.

4. A metallic sheet comprising a flattened body bounded by edge portions and conditioned to be positioned on and subsequently shaped by a forming die into a part of predetermined shape, said die having a sheet guide and positioning pin extending outwardly therefrom, said sheet having a sheet positioning and guide slot formed therein for cooperation with the sheet guide and positioning pin to position the sheet on said forming die, said positioning and guide slot comprising a primary slot having opposing edges defining a width having to accommodate said positioning pin and guide and position said sheet into a forming position on said die, said primary slot leading from an edge portion of said sheet to a predetermined end point in said sheet and a branch slot extending from the end point of said primary slot and at a predetermined angle with respect to said primary slot, a boundary slot disposed to one side of said primary slot and extending to a terminus and cooperating with the end of said branch slot to define a live hinge in said body of said sheet to allow a predetermined portion of said sheet to bend therealong after said sheet has been formed by said die into a part to allow said formed part to be removed from said die without further bending and deformation thereof.

5. A method of forming a sheet of alloy of superplastic forming metal into a formed part using equipment including a forming die having an upstanding guide pin adjacent to one edge thereof the die and the sheet having a guide pin slot and an adjacent boundary slot formed in the edge thereof comprising the steps of:

a. positioning a sheet of superplastic forming material onto said forming die so that the guide pin is received in said slot to guide said sheet into a predetermined position onto said forming die;

b. heating the forming die so that the temperature of said sheet reaches a temperature for plastic forming;

c. supplying pressurized gas into the equipment to effect the stretching of the sheet on the profiling die and deforming the sheet material into a part having the profile of the forming die and closing said guide pin slot so that it binds to the guide and positioning pin;

d. opening the press;

e. displacing the part from the profiling die and consequentially bending the part in a predetermined sacrificial bend area defined between said guide slot and said boundary slot to effect release of the part from the guide and positioning pin.

6. The method of claim 5 and further comprising the step of effecting the limited turning of said sacrificial area along said bend line to increase the spacing between the side edges of said guide pin slot to effect clearance between said side edges and said pin to allow said formed part to be removed from said forming die and without part distortion detracting from the operative form of said part.

* * * * *